United States Patent [19]

Lohman et al.

[11] 4,033,328

[45] July 5, 1977

[54] TAR MELTING KETTLE

[75] Inventors: John H. Lohman; Richard C. Brooke, both of San Antonio, Tex.

[73] Assignee: Blackwell Burner Company, San Antonio, Tex.

[22] Filed: Nov. 26, 1975

[21] Appl. No.: 635,428

[52] U.S. Cl. ..... 126/343.5 A; 214/17 B

[51] Int. Cl.[2] ..... E01C 19/45

[58] Field of Search ..... 126/343.5 A; 214/35 R, 214/17 B, 35 A; 55/320, 467; 110/119; 122/116

[56] References Cited

UNITED STATES PATENTS

| | | | |
|---|---|---|---|
| 1,429,711 | 9/1922 | Brown | 214/35 A |
| 2,227,749 | 1/1941 | Gooder | 214/17 B |
| 2,230,076 | 1/1941 | Etnyre | 126/343.5 A |
| 2,830,577 | 4/1958 | Walter, Jr. | 126/343.5 A |
| 2,841,071 | 7/1958 | Strawsine | 126/314 |
| 3,046,717 | 7/1962 | Northrup et al. | 55/320 |
| 3,732,075 | 5/1973 | Acaba | 55/467 |
| 3,804,079 | 4/1974 | Schrader | 126/343.5 A |
| 3,894,926 | 7/1975 | Lee | 214/17 B |

*Primary Examiner*—John J. Camby

*Assistant Examiner*—Larry I. Schwartz

[57] ABSTRACT

This invention relates to kettles used for the melting of tar and/or asphalt. The kettle is normally mounted on a base frame having an axle and tires for towing behind a truck, but the kettle may be stationary or semi-permanent. The flames and hot gases from a gas burner flow through tubes in the kettle to melt blocks of tar. The melted tar is then pumped by a motor driven pump from the kettle to the surface where it is being used. To add blocks of tar to the kettle for melting, a double rotating cylinder is used so that the melting tar is not exposed to atmosphere. When the cover is raised so that a first opening in an outer cylinder is exposed to atmosphere, a block of tar is inserted. The inner cylinder has an opening in line with the first opening of the outer cylinder. Thereafter upon closing the cover and rotating the inner cylinder, the block of tar falls from the inner cylinder through a second opening in the outer cylinder into the kettle. The second opening for the outer cylinder is always closed to atmosphere thereby keeping the contents of the kettle from being exposed to atmosphere. A special filter prevents particles contained in fumes inside the kettle from reaching the atmosphere through a vent for the kettle.

12 Claims, 5 Drawing Figures

TAR MELTING KETTLE

BACKGROUND OF THE INVENTION

This invention relates to a tar melting kettle and, more particularly, a kettle having a specially designed top to prevent exposure of the melting tar to atmosphere both upon insertion of extra blocks of tar for melting and in the vent line for the kettle.

Prior to the present invention, any different types of tar melting kettles have been used. Typically, the kettles would have a base frame to which would be attached an axle with wheels located on each end thereof. A draw bar on the front of the base frame would allow the kettle to be easily moved from one location to another. The vat portion of the kettle would be mounted on the base frame with a lid being used to cover the kettle. Normally, the lid would have a handle bar opening from the side to allow the insertion of blocks of tar through the lid into the vat. The vat would be heated by a burner which would have appropriate tubes flowing through the bottom of the kettle to allow flames from the burner to heat the tar. As the tar melts, a pump operated by a motor outside of the vat would pump the tar through the top of the kettle to any desired location.

In the prior kettle just discussed, the lid normally consisted of a reinforced frame which attached to the top of the vat with a special cover being opened by handle from one side. Upon opening the cover, the melted tar inside of the vat is exposed to atmosphere which causes a very foul smell and pollution of the atmosphere. Upon dropping a block of tar into the vat, some of the melted tar would inevitably splash from the vat onto the person inserting the tar. Also, the vat would normally be vented to atmosphere again adding to the foul smell and pollution. Overnight the cover of the kettle would stick causing it to be very hard to open the following day. Many times the vat would have to be heated simply to open the cover even prior to inserting tar for melting.

A typical tar melting kettle is shown in U.S. Pat. No. 3,804,079, a copy of which is enclosed for the Examiner.

SUMMARY OF THE INVENTION

It is an object of the present invention to provide a tar and/or asphalt melting kettle that is safe to use and does not pollute the atmosphere.

It is another object of the present invention to provide a tar melting kettle having a unique double rotating cylinder in the lid for insertion of blocks of tar into the vat.

It is yet another object of the present invention to provide a lid for a vat of a tar melting kettle that does not expose the melting tar to the atmosphere.

It is even another object of the present invention to provide a stationary cylinder in the lid of a vat with a rotating cylinder being contained therein, and a rotating cover outside of the stationary cylinder so that a block of tar may be inserted into the rotating cylinder by raising the cover and rotating the cylinder to a given position. Thereafter, by replacing the cover and rotating the cylinder to a second position, the block of tar is dropped into the vat without exposing the melting tar to atmosphere or splashing the tar outside of the vat.

It is another object of the present invention to provide an auxiliary loading capability through the lid so that tar may be added to the vat through auxiliary openings during startup.

It is yet another object of the present invention to provide a unique filtering system for the vent that extends from the vat, through the lid of the vat to atmosphere.

DESCRIPTION OF THE PREFERRED EMBODIMENT

Figure 1:
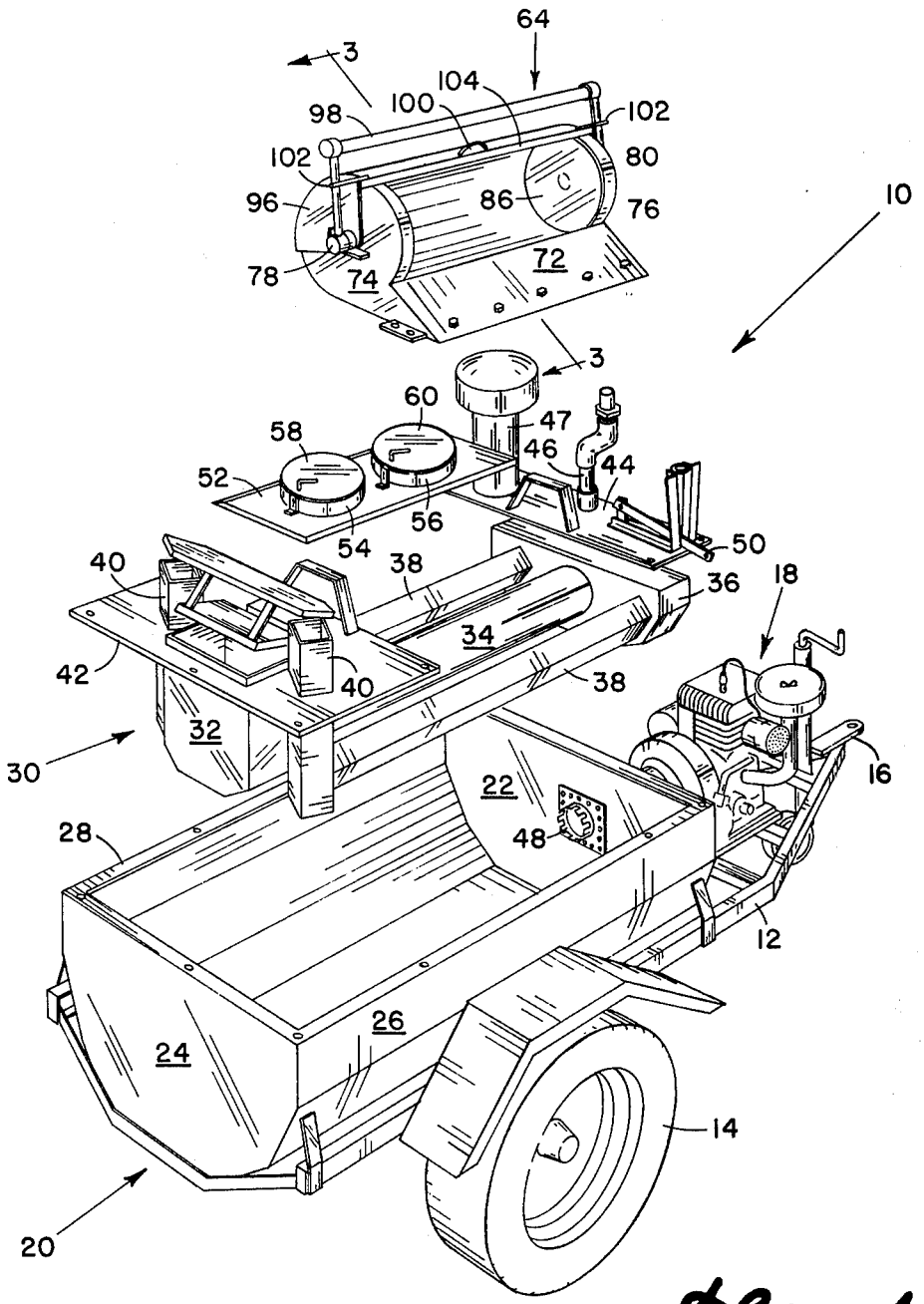
FIG. 1 is an exploded perspective view of the tar and/or asphalt melting kettle.
Figure 2:
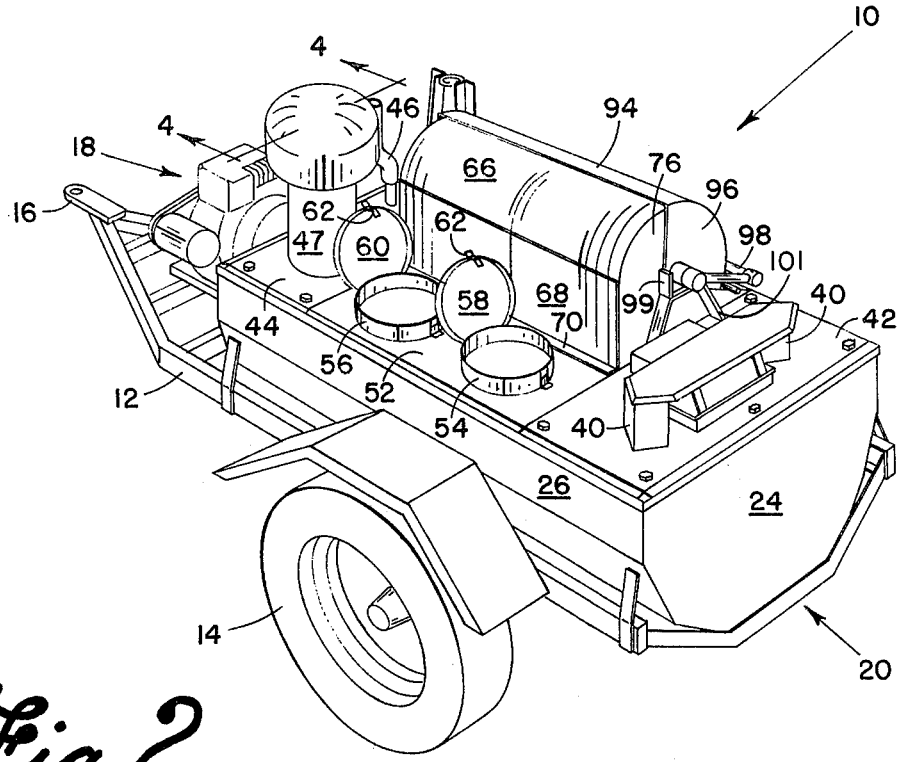
FIG. 2 is an upper perspective view of a tar melting kettle showing the top.

Referring now to FIGS. 1 and 2 in combination, there is shown a tar melting kettle represented generally by the reference numeral 10. The tar melting kettle 10 has a base frame 12 to which is attached an axle (not shown) with wheels 14 being located on the end thereof. The front portion of the base frame 12 comes together with a trailer hitch 16 being connected thereto. On the front of the base frame 12 is located a gasoline operated motor 18 that is used to drive a pump (not shown) as will be subsequently described.

Towards the rear of the base frame 12, a vat 20 is connected to the base frame 12. The vat 20 consists generally of end walls 22 and 24 and a generally semi-cylindrical side 26. The top of the vat 20 has a reinforced upper ledge 28. Inside of the vat 20 is located an immersion tube unit 30 that is used to heat the kettle 10. A burner (not shown) is located inside of burner well 32. Flames from the burner are conducted through tube 34, connecting box 36 and square return tubes 38. From the square return tubes 38, the exhaust from the burner leaves through flues 40. The top of the immersion tube unit 30 has a plate 42 that bolts to reinforce upper ledge 28 of vat 20.

Towards the front of vat 20 is located a cross plate 44 that attaches to the reinforced upper ledge 28. Extending through the cross plate 44 is a vent 47 as will subsequently be described in full detail. Also extended through cross plate 44 is a conduit 46 that connects to a pump (not shown) located inside the vat 20 that is used to pump the melted tar through conduit 46 to any desired location. The pump is located behind the connecting box 36 and the end wall 22 with an inlet being near the bottom center of the vat 20 and the outlet connecting to conduit 46, all of which is well known in the art. The pump is driven by the gasoline operated motor 18 through a drive shaft connection 48. By the raising of lever 50 which operates the pump, melted tar or asphalt is pumped through conduit 46.

Extending between plate 42 and cross plate 44 is located side plate 52. Side plate 52 has two cylindrical openings which are connected to cylinders 54 and 56. To the top of cylinders 54 and 56 are connected lids 58 and 60, respectively, which may be opened for the insertion of a block of tar. Each of the lids 58 and 60 are normally held closed by latches 62. The lids 58 and 60 of cylinders 54 and 56, respectively, are used to insert blocks of tar only during startup operations, but will be closed once the tar has melted. This is very important because the normal method of inserting tar for the present invention, as will be subsequently described in more detail, will have a tendency to stick shut when the kettle 10 is not in use thereby making startup operations difficult.

Figure 3:
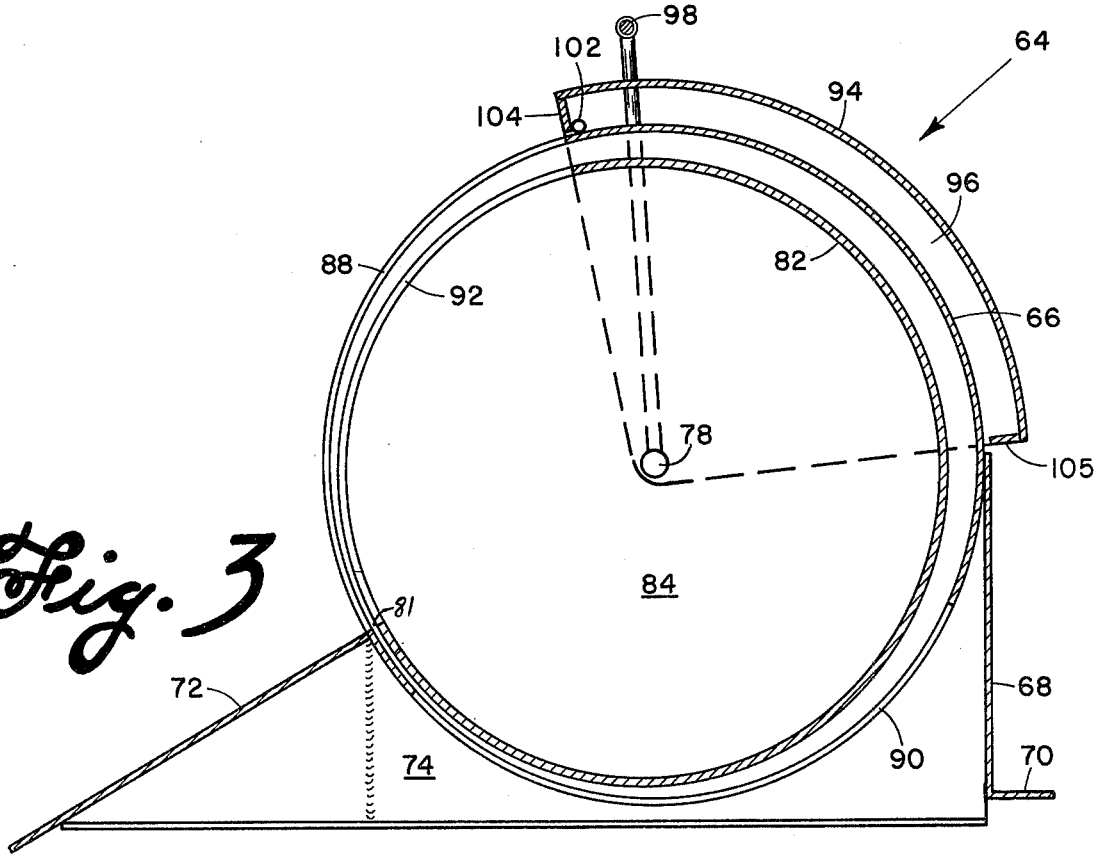
FIG. 3 is a sectional view along section lines 3—3 of FIG. 1 of the double rotating cylinder.

Referring now to FIG. 3 in combination with FIGS. 1 and 2, there is shown a double rotating cylinder 64 for loading blocks of tar into the kettle 10. The double rotating cylinder consists basically of a stationary cylinder 66 which is attached to a back wall 68 by any suitable means such as welding. The back wall 68 connects to side plate 52 by means of flange 70. Also the stationary cylinder 66 connects to sloping front wall 72 by any suitable means such as welding. The front wall 72 connects to reinforced upper ledge 28. Attached to each end of stationary cylinder 66 are end plates 74 and 76. The end plates 74 and 76 enclose the area between back wall 68, sloping front wall 72 and the ends of stationary cylinder 66 so that fumes from the vat can not escape.

Near the center of each end of the stationary cylinder 66, and mounted in the end plates 74 and 76, are located pivot bars 78 and 80. Connected to the pivot bar 80 is an inner rotating cylinder 82 having end plates 84 and 86. Pivot bar 78 extends through end plates 74 and pivot bar 80 extends through end plates 76, thereby allowing inner rotating cylinder 82 to pivot with pivot bars 78 and 80 to which it is attached. The pivot point is slightly off center of the stationary cylinder 66 to allow a minimum clearance between the inner rotating cylinder 82 and the stationary cylinder 66 at point 81 of the stationary cylinder 66. This prevents the escaping of fumes from the vat 20 to atmosphere as will subsequently be more apparent.

Referring now to FIG. 3, it can be seen that stationary cylinder 66 has a feed opening 88 cut essentially the full length of stationary cylinder 66 to allow blocks of tar to be inserted therethrough. Also, stationary cylinder 66 has a bottom opening 90 located therein, again cut essentially the entire length of stationary cylinder 66. Rotating cylinder 82 has a rotating opening 92 located therein. When the rotating opening 92 is in line with feed opening 88, a block of tar may be inserted into the inner-rotating cylinder 82 if cover 94 is raised. Cover 94 pivots on the same pivot bars 78 and 80, which connect to inner cylinder 82. However, cover 94 rotates independently of inner cylinder 82 with pivot bars 78 and 80 being the axis of rotation. It should be realized that the cover 94 is formed from a larger arcuate portion of a cylinder than the openings 88 and 92 of cylinders 66 and 82, respectively, to cover the openings thereof.

While cover 94 is freely rotating on pivot bars 78 and 80, the inner rotating cylinder 82 is pined to rotate with the pivot bars 78 and 80 along with handle 98. Therefore, when handle 98 is raised until it abuts stop 99 of support structure 101, inner rotating cylinder 82 will rotate thereby raising rotating opening 92 to the position as shown in FIG. 3. By raising the cover 94 by means of handle 100 to the position shown in FIG. 3, a block of tar may be inserted through the stationary opening 88 and rotating opening 92. After closing the cover 94 by means of handle 100, the inner rotating cylinder 82 may be rotated by means of handle 98 to the position shown in FIG. 2. This will allow the block of tar to drop through rotating opening 92 of inner cylinder 82 and bottom opening 90 of stationary cylinder 66 into the vat 20. By operating the double rotating cylinder 64 in this manner, additional blocks of tar may be added to the vat without opening the vat to atmosphere and without splashing melted tar from the vat 24.

To insure that the cover 94 is closed upon rotating inner cylinder 82 to the position shown in FIG. 2, extensions 102 have been connected adjacent the front lip 104 of cover 94. These extensions 102 will hit against handle 98 if someone attempts to turn internal rotating cylinder 82 without the cover 94 being closed. Due to the weight of the cover and to the size of the openings 88, 90 and 92, the cover 94 will be closed prior to the block of tar hitting the melted tar. There will not be an appreciable period of time during which the vat 24 could be open to atmosphere. This is a safety precaution to insure that the cover 94 is closed prior to inserting blocks of tar into vat 20.

The front lip 104 of cover 94 seals with front wall 72 when it is in the closed position. Also, rear lip 105 of cover 94 rubs against the upper surface of stationary cylinder 66 when the cover 94 is in the closed position. This is caused from the off center location of pins 78 and 80. The front lip 104 and the rear lip 105 should be made from a resilient substance to form better seals, and simultaneously, prevent fumes from the vat 20 from reaching atmosphere.

Figure 4:
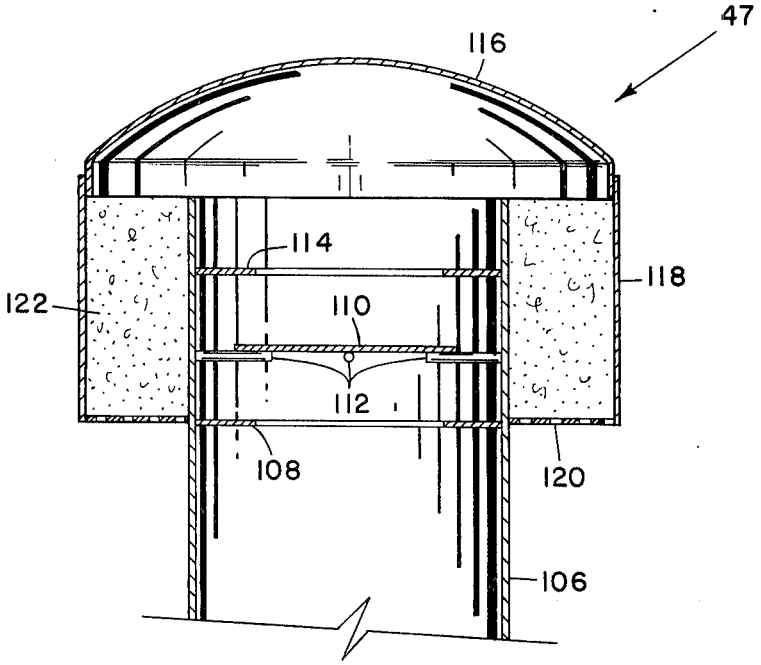
FIG. 4 is a cross-sectional view of the vent from the vat to atmosphere.

Referring now to FIG. 4 there is shown the vent 47 previously mentioned in conjunction with the description of FIGS. 1 and 2. The vent 47 consists of a large conduit 106 that connects through crossplate 44 to the inside of vat 20. Inside of conduit 106 is located an annular flange 108. Shortly above the annular flange 108, is located a center plate 110 that is held into position on pins 112 by any suitable means such as welding. Above center plate 110 is located another annular flange 114. Surrounding the top of conduit 106 is cap 116 that connects to annular section 118 which surrounds the top of conduit 106. The annular section 118 has a perforated lower inner flange 120 that connects to conduit 106. In the annular space between annular sections 118 and conduit 106 is located filter material 122. By requiring the ventilation through vent 47 to flow around annular flange 108, center plate 110 and annular flange 114, the majority of the solid particles suspended in the gaseous fumes will strike these objects and fall back into the vat 20. In case some of the solid particles do not fall back into vat 20, filter material 122 will trap the remaining solid particles to prevent pollution of the atmosphere. The gases may cool inside conduit 106 so that the gases may be condensed on the filter material 122.

It should be realized that all portions of the top of vat 20, connected to reinforced upper ledge 28 or otherwise, seal to prevent the escaping of fumes from the vat 20. By use of the double rotating cylinder 64, it is not necessary to open the vat 20 to atmosphere during normal operations. Even the vent 47 is filtered to prevent the pollution of the atmosphere. For startup operations when the double rotating cylinder 64 may be stuck, lids 58 and 60 provide a means for alternative loading of the vat 20. This is before the polluting fumes have started. Once the vat is loaded during startup operations and double rotating cylinder 64 is freed by the melting of the tar, the lids 58 and 60 will be closed and latched.

Figure 5:
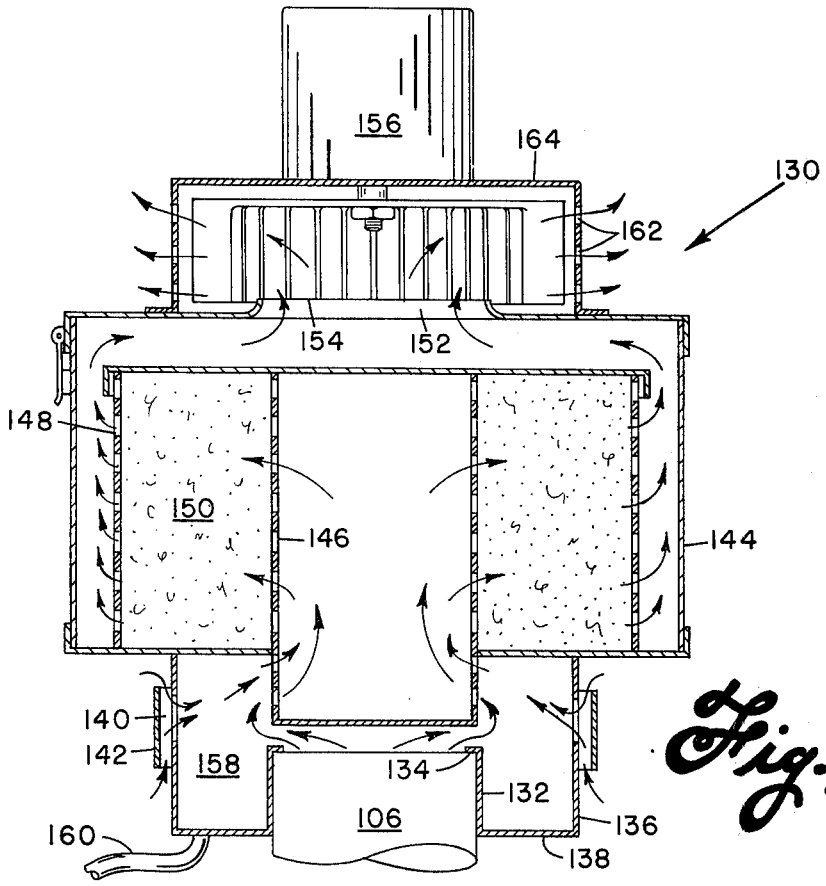

Referring now to FIG. 5, there is shown an alternative filtering device 130 from the one shown in FIG. 4 wherein the filter shown in FIG. 4 may be removed from conduit 106 and replaced with the alternative filtering device 130. A lower concentric cylinder 132 encircles conduit 106 and rests on the upper portion thereof by means of a flanged shoulder 134. An outer concentric cylinder 136 surrounds both conduit 106 and lower concentric cylinder 132. The annulus 158 formed between cylinder 132 and 136 is terminated at the lower end thereof by end plate 138. In the outer concentric cylinder 136 are located air intake holes 140 controlled by adjustable cover 142.

The top of cylinder 136 connects to a filter housing 144. In the center of the filter housing 144 is located an inner perforated cylinder 146. An outer perforated cylinder 148 is concentric with the inner perforated cylinder 146 with a filter material 150 located therebetween. At the top center of the filter housing 144 is located an opening 152. Adjacent opening 152 is located fan 154 driven by motor 156 (preferably electric). Gas fumes are drawn from conduit 106 along with cool air through intake holes 140. The outside air cools the gas fumes so that as they both flow through the perforations in perforated cylinder 146 and the filter 150 the solid particles in vapor form will collect in liquid form and drain back into annular space 158. From annular space 158, the collected material, flows through drain line 160 either back into the vat 20 or to another collection container. The cooled, filtered air and gases from vat 20 flow from filter 150, through opening 152, fan 154 and perforations 162 in fan housing 164 to the atmosphere. Most of the pollutants have been removed from the gas fumes of the vat 20 by the filter 150 prior to discharge to the atmosphere. It has been found through experimentation that the filter and gas flowing through the vent should be approximately 133° F. or less. This insures that the vapor particles, commonly known as "light ends", will collect in the filter and never reach the atmosphere in the form of smoke. Normally the light ends would drain back into the kettle to help prevent the brittle nature of the tar when solidified. Also, at the same time, it is very important to keep the temperature as high as possible by drawing the minimum amount air over the liquid surface of asphalt. This is accomplished by the adjustable nature of the cover 142. Adjustable cover 142 is opened only to the extent that smoke no longer reaches atmosphere through opening in the top of the kettle 10.

We claim:

1. A kettle for melting tar, said kettle having a base frame with means for moving said kettle attached thereto, burner means for melting tar in a vat of said kettle, means for removing melted tar from said vat, improvement of said kettle comprising:

lid means for said vat, said lid means sealing with an upper edge of said vat;

stationary housing adapted for receiving a rotating cylinder means, said stationary housing being mounted in said lid means;

pin means in opposing ends of said stationary housing;

rotating cylinder means inside said stationary housing mounted on said pin means inside said stationary housing;

first opening in said stationary housing and a second opening in said rotating cylinder means adapted so that blocks of tar may be inserted through said first opening and said second opening, after rotating said rotating cylinder means via said pin means, said blocks of tar drop through said second opening and a third opening located in said stationary housing into said vat;

said rotating cylinder means being rotatable by a turning means outside said stationary housing connected to said pin means, upon moving said turning means to a first position said first opening and said second opening are in line to allow insertion of said blocks of tar therethrough into said rotating cylinders, upon moving said turning means to a second position said second opening and said third opening are in line to allow said blocks of tar to drop into said vat;.

cover means adapted to cover said first opening rotatably mounted on said stationary housing.

2. The kettle as recited in claim 1 wherein said turning means includes a handle means, upon moving said handle means to said first position said cover means may be moved to a load position, subsequent movement of said handle means to said second position causes said handle means to abut said cover means and return said cover means to its normal position.

3. The kettle as recited in claim 1 wherein said lid includes a vent for said vat to atmosphere, said vent including baffle means inside a conduit so that solid particles in fumes from said vat would strike said baffles and drop back into said vat.

4. The kettle as recited in claim 3 wherein said vent includes cap means for directing said fumes downward around the outside of said conduit, said cap means including filler means in an annular space between said cap means and said conduit means.

5. The kettle as recited in claim 1 wherein said lid includes auxiliary opening means therein for inserting blocks of tar directly into said vat during startup, said auxiliary opening means have cover means therefor for closing said auxiliary opening means after startup.

6. The kettle as recited in claim 2 wherein said pin means is off center of longitudinal axis of said stationary housing, said off center location of said pin means locating said rotating cylinder means against immediately adjacent a lower edge of said first opening of said stationary housing in said first position to prevent fumes from escaping from said vat.

7. The kettle as recited in claim 6 wherein said cover means includes means for sealing with said lid when said cover means is in said normal position, said cover means also being cammed with respect to said stationary housing.

8. The kettle as recited in claim 1 wherein said lid includes a vent for said vat to atmosphere, said vent includes means for drawing air from atmosphere through an external opening to combine with fumes from said vat to cool said fumes, solid particles in said fumes collecting in a filtering means and draining from inside said vent.

9. The kettle as recited in claim 8 wherein said means for drawing air includes a motor powered fan which draws said air through said external opening for cooling said fumes, said fan further drawing said cooled fumes through said filter before discharge to atmosphere, draw of said fan being sufficient to prevent fumes from escaping through said external opening.

10. The kettle as recited in claim 8 wherein said external opening is adjustable to cooperate for variations in operating conditions.

11. The kettle as recited in claim 1 wherein said cover means is mounted on said pin means, said cover means including an abutting surface for covering said first opening by said turning means upon moving said second opening from said first position to said second position.

12. The kettle as recited in claim 11 wherein said cover means and said stationary housing have generally arcuate inner surfaces along their elongated axis.

* * * * *